United States Patent [19]

Aquilina

[11] Patent Number: 5,040,332

[45] Date of Patent: Aug. 20, 1991

[54] PNEUMATIC DOOR OPERATOR

[76] Inventor: Anthony G. Aquilina, R.R. 5, Milton, Ontario, Canada, L9T 2X9

[21] Appl. No.: 216,879

[22] Filed: Jul. 8, 1988

[51] Int. Cl.[5] ..... E05F 15/00

[52] U.S. Cl. ..... 49/200; 49/361; 92/88

[58] Field of Search ..... 49/200, 199, 356, 445, 49/361; 160/189, 190, 191; 92/88, 165

[56] References Cited

U.S. PATENT DOCUMENTS

| | | | |
|---|---|---|---|
| 2,330,006 | 9/1943 | Odenthal . | |
| 3,221,610 | 12/1965 | King et al. | 92/88 |
| 3,231,259 | 1/1966 | Bobrowski et al. . | |
| 3,319,303 | 5/1967 | Salvo . | |
| 3,349,516 | 10/1967 | Armstrong . | |
| 3,537,503 | 11/1970 | Simmonds . | |
| 3,893,378 | 7/1975 | Hewitt . | |
| 4,231,191 | 11/1980 | Ellmore . | |
| 4,414,779 | 11/1983 | Carli | 49/199 |
| 4,417,418 | 11/1983 | Waring . | |
| 4,481,869 | 11/1984 | Garlapaty . | |
| 4,519,297 | 5/1985 | Lipinski . | |

FOREIGN PATENT DOCUMENTS

| | | | |
|---|---|---|---|
| 475597 | 7/1951 | Canada | 160/191 |
| 7604919 | 11/1976 | Netherlands . | |

OTHER PUBLICATIONS

Tol-O-Matic product brochure; Tol-O-Matic, Inc. 1028 S. 3rd St., Minneapolis, MN 55415.

Tol-O-Matic Band Cylinder Brochure.

*Primary Examiner*—Kenneth J. Dorner

*Assistant Examiner*—Gerald A. Anderson

*Attorney, Agent, or Firm*—Fay, Sharpe, Beall, Fagan, Minnich & McKee

[57] ABSTRACT

An operator system for a counterbalanced door includes a rodless fluid cylinder that has a cylinder body and a rodless piston adapted for reciprocation in the cylinder body. A carriage which is adapted for reciprocation externally along the length of the cylinder body is secured to the piston. A link member connects the cylinder carriage to a door or to a torsion bar for the door. A control circuit is provided for controlling the operation of the fluid cylinder and hence the position of the door.

22 Claims, 4 Drawing Sheets

PNEUMATIC DOOR OPERATOR

BACKGROUND OF THE INVENTION

The present application is a continuation-in-part of application Ser. No. 029,733 filed on Mar. 24, 1987 now abandon.

This invention generally pertains to a pneumatic door operator construction. More specifically, the present invention relates to a sliding door operator system which utilizes a rodless fluid cylinder for mechanically opening and closing a door.

The invention is particularly applicable to sectional overhead doors of the multiple panel type in which the door is aided in being raised and lowered by a counterbalance means such as a torsion bar and will be described with particular reference thereto. However, it will be appreciated by those skilled in the art that the invention has broader applications and may also be adapted for use in many other environments such as single panel overhead lift doors, overhead roller doors, bi-parting doors, and even sideward sliding doors or the like.

Most overhead doors are counterbalanced with a torsion spring or a counterweight system for storing energy during door closing so that energy may be extracted during door opening. During opening, most of the energy for lifting such a door is derived from the energy stored in the spring or counterweight system. If the door is counterbalanced fairly well, the amount of manual energy required to open the door need only be sufficient to make up the frictional and other losses in the system. During door closing, the energy required is that for making up the frictional and other losses since most of the energy which is transferred to the spring or counterweight storage system is derived from the weight of the descending door.

In general, conventional overhead doors of this nature are suspended by a cable which is wound around a drum axially driven through a shaft by the torsion spring with the shaft being rotated by a chain driven sprocket. Generally, the chain is driven by an electric motor. In some environments, however, the use of electrical motors is undesirable because of the possible danger of a spark causing an explosion or a fire. It has also been found that electric motors are disadvantageous since if the door becomes jammed the motor will continue rotating and will likely unwind the cable between the drum and the door and this could prove hazardous to personnel and may damage property.

Also, when such doors go through a high number of cycles, such as in a car or truck wash, or in factories, warehouses or the like, the electrical motors, and bearings wear out at a fairly rapid rate and this results in frequent breakdowns of the door opening mechanism. Moreover, malfunctions of the door opening mechanism sometimes also lead to damage to the torsion spring mechanism of the door which can be fairly expensive to repair.

Some conventional trolley type and jack shaft type pneumatic cylinder door operators are known to the art. However, every one of these includes a piston rod extending out of the cylinder which increases the length of the operator and the amount of room necessary to mount the operator.

One recent suggestion has been to utilize a pair of pneumatic cylinders in a side mounted operator for moving the chain of the chain driven sprocket by the use of piston rods thereby rotating the sprocket. However, side mounted operators are not recommended when a trolley operator could be used in their place since with a side mounted operator any hesitation in door travel results in an unwinding of the cable from the torsion bar drum which makes the door liable to a free fall that could cause grave injury to people as well as damage to objects under the door and to the door itself.

For certain types of doors, such as high-lift type vertical lift doors and roll up type doors, a trolley operator cannot be used and thus a side mounted so-called jack shaft operator has to be used. The conventional electric motor powered jack shaft operators are disadvantageous for the reasons previously mentioned. The side mounted dual piston type system is also disadvantageous since the design of this system will produce a constant downward torque on the main door shaft and also will exert an unnecessarily heavy load on the end bearing where the shaft is suspended. This wears the bearing and can cause the bearing plate to cut through the shaft. With this type of operator, the chain can jump the sprocket and the cable can jump the drum every time the door hesitates during its travel, or the chain goes slack, or if the shaft becomes bent at some point during door operation. Another difficulty with the conventional side mounted pneumatic cylinder system is that it is mounted near the bottom of the door and in this location the door track may get hit by a vehicle which can also damage the cylinders. In addition, in wet and cold environments, moisture in the air can freeze in the cylinders thereby damaging the seals on the piston rod and causing air leaks and hence a malfunction of the door. In addition, on relatively low doors, i.e. 7 to 10 foot high doors, the chain of the conventional dual piston system can be hazardous to personnel since the chain is so located that it can entangle the limbs, or hair, of personnel.

Accordingly, it has been considered desirable to develop a new and improved jack shaft type door operator system which could be mounted either horizontally normal to the closed door or vertically parallel to the door and would overcome the foregoing difficulties and others while providing better and more advantageous overall results.

BRIEF SUMMARY OF THE INVENTION

According to one aspect of the invention, an operator is provided for opening and closing a door in which the weight of the door is substantially counterbalanced by a torsion spring assembly including a drive rod.

According to this aspect of the invention, a rodless fluid cylinder is provided comprising a cylinder body, a rodless piston adapted for reciprocation in the cylinder body, and a carriage adapted for reciprocation externally along the length of the length of the cylinder body. The carriage is secured to the piston. A link means is provided for connecting the cylinder carriage to one of the door and the drive rod. The link means can comprise a looped chain, which is secured to the cylinder carriage, and a sprocket wheel, which is secured to a bushing that rotates the torsion bar. The chain is looped around the sprocket wheel. A control means is provided for controlling the operation of the fluid cylinder and hence the position of the door.

In accordance with yet another aspect of the invention, an air powered operator system is provided for a door that is raised and lowered with the aid of a torsion bar.

More specifically in accordance with this aspect of the invention, the system comprises an air cylinder comprising an elongated cylinder body, a rodless piston adapted for reciprocation in the cylinder body, and a carriage adapted for reciprocation externally along the length of the cylinder body and secured to the piston. A looped chain is secured to the carriage that rotates the main drive sprocket. A sprocket wheel is secured to the torsion bar and the chain is looped around the sprocket wheel. A source of pressurized air which is in fluid communication with the cylinder is provided. A valve means is interposed between the source of pressurized air and the air cylinder for selectively feeding pressurized air to the air cylinder to reciprocate the rodless piston therein.

One advantage of the present invention is the provision of a new door operator system which can actuate most types of overhead doors that have a counterbalance means and can also actuate selected rolling doors, and bi-parting doors.

Another advantage of the present invention is the provision of a door operator system which actuates a door by the movement of a rodless piston which reciprocates in a cylinder.

Still another advantage of the present invention is the provision of a pneumatically powered jack shaft type door operator system which can be mounted either horizontally normal to the closed door or vertically parallel to the door.

An additional advantage of the present invention is the provision of a door system with a rodless cylinder operator which moves a chain that is looped around a drive sprocket which is secured to a bushing that is connected to and drives the main door shaft of a counterbalanced door.

A further advantage of the present invention is the provision of a door operator system which opens and closes a door with a minimum of force thereby preventing injury to persons or damage to objects which are inadvertently left in the path of the door when the door is being moved.

A still further advantage of the present invention is the provision of a door operator system with a means for controlling the speed with which the door moves.

A yet further advantage of the present invention is the provision of a door operator system with a means for keeping the door stationary when the operator stops the door in mid-travel.

Still other advantages and benefits of the present invention will become apparent to those skilled in the art upon a reading and understanding of the following detailed specification.

BRIEF DESCRIPTION OF THE DRAWINGS

The invention may take physical form in certain parts and arrangements of parts, preferred embodiments of which will be described in detail in this specification and illustrated in the accompanying drawings which form a part hereof and wherein.

DETAILED DESCRIPTION OF THE PREFERRED EMBODIMENTS

Figure 1:
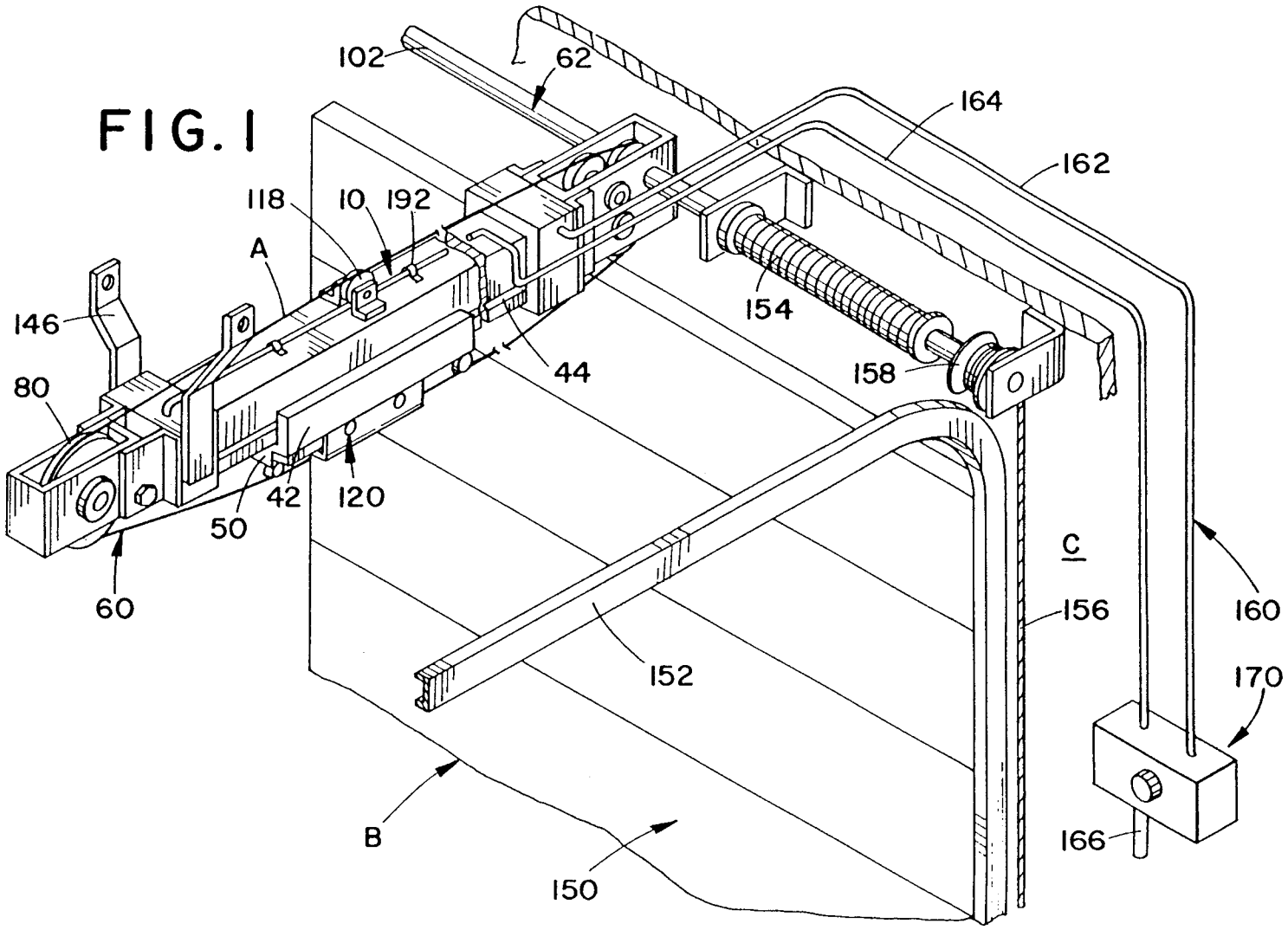
FIG. 1 is a perspective view of the door operator system mounted horizontally and normal to a closed sectional overhead door of a building according to a first preferred embodiment of the present invention.

Referring now to the drawings wherein the showings are for purposes of illustrating preferred embodiments of the invention only and not for purposes of limiting same, FIG. 1 shows the subject new jack shaft type door operator system A which is mounted horizontally and normal to a closed door B which closes an opening in a building C. While the door operator is primarily designed for and will hereinafter be described in connection with a sectional overhead sliding door, it should be appreciated that the overall inventive concept involved could be adapted for use in many other door environments as well.

Figure 2:
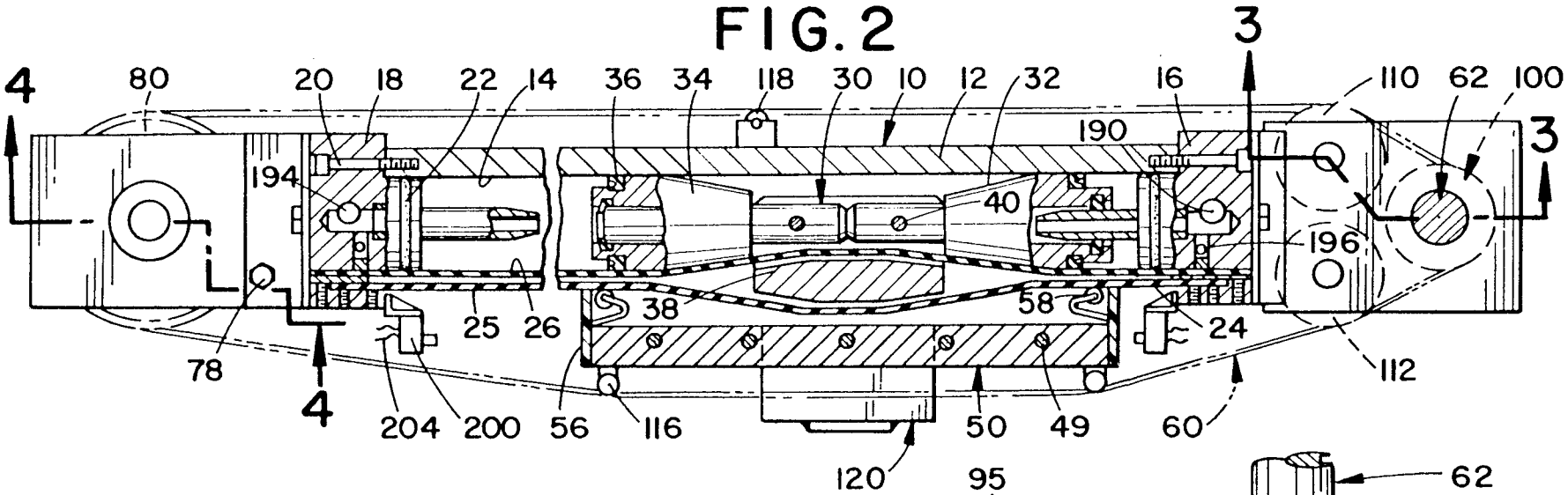
FIG. 2 is an enlarged side elevational view partially in cross-section of a rodless cylinder operator of the system of FIG. 1.

With reference now to FIG. 2, the operator system A includes a cylinder member 10 which comprises a tubular body 12 that has a longitudinal bore 14 extending therethrough. A first end of the bore is closed by a first end cap member 16 with a second, and opposite, end of the bore 14 being closed by a second end cap member 18. Suitable fasteners 20 secure the first and second end caps 16,18 to the tubular body 12. A suitable seal means 22 is provided for each of the end caps 16,18 to prevent pressurized air from leaking therethrough.

As is known in rodless cylinders, and is more completely described in Ser. No. 029,733, a slot 24 extends longitudinally along one side of the tubular body 12 to communicate the bore 14 with the environment. A pair of spaced sealing bands or strips 25,26 seal the slot to isolate the bore 14 and prevent pressurized fluid from leaking out therethrough. The bands are secured to the two end caps 16,18.

Adapted to reciprocate longitudinally in the bore 14 of the cylinder is a piston body 30 which is comprised of a pair of identical and opposing sections 32,34 that are joined together in a suitable conventional manner. A seal means 36 extends peripherally around each section 32,34 of the piston to provide a seal between the piston section and the cylinder bore 14.

A piston bracket 38 is secured by suitable conventional fasteners 40 to the first and second sections 32,34 and is adapted to extend through the cylinder slot 24. A section of the bracket 38 is positioned outwardly of the tubular body 12 and extends along substantially one face thereof as is illustrated best in FIG. 1. This outer section has depending sides 42 to each of which can be secured an inwardly extending bearing rod (not visible) which slides in suitably configured grooves 44 formed in the outer periphery of the tubular body so as to allow a smooth sliding motion of the piston bracket 38 as the piston moves. This system allows the cylinder 10 to withstand high axial and radial loads and moments while eliminating the requirement for external guides and supports.

Secured to the piston bracket 38 by suitable conventional fasteners 49 is a traveler or carriage 50. The carriage has a base wall and a pair of side walls (not visible), and a pair of opposing end walls 56. Seal means 58 in the form of wiper seals are provided on the end walls 56 of the carriage and act to clean the second seal band 26 of the cylinder 10.

Figure 5:
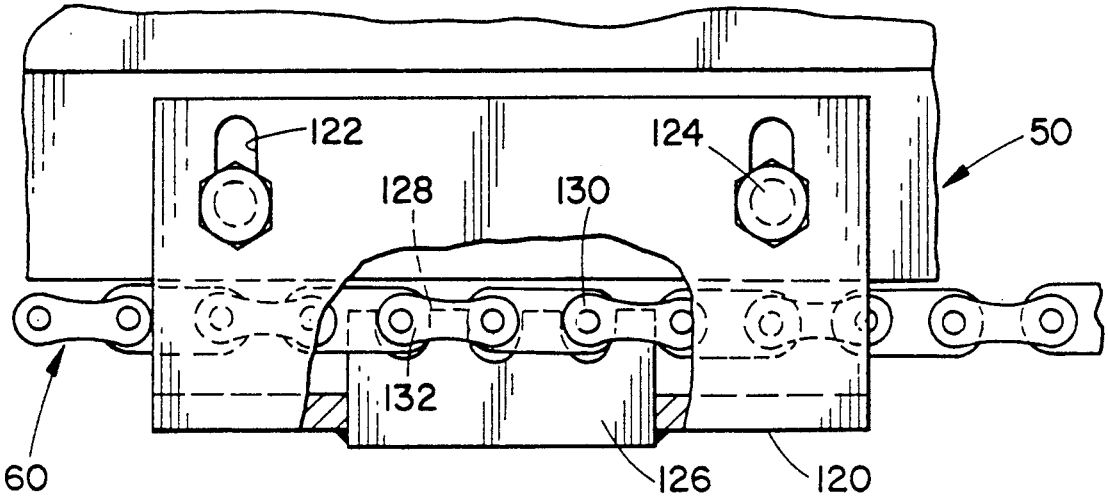
FIG. 5 is an enlarged side elevational view, partially broken away, of a cap and chain keeper section of the air operator carriage of FIG. 2.

A link means is provided for connecting the cylinder carriage to the torsion bar. In the preferred embodiment, the link mean comprises a chain 60, such as a bicycle chain (as best seen in FIG. 5), which is secured to the carriage 50 and is looped around a torsion bar or drive rod 62 of the garage door.

While the instant rodless cylinder apparatus is similar to the construction disclosed in the parent application, Ser. No. 029,733, it is of considerably different dimensions. More specifically, if, for example, a 16 ft. high door is meant to be opened by the parent application's trolley operator, the operator would require a 16 ft., 6 inch stroke and thus the rodless cylinder thereof would need to be at least that long. In contrast, the jack shaft operator according to the present invention for the same 16 ft. door would only require an approximately 8 ft. stroke and thus the rodless cylinder's length could be considerably shorter. However, the chain drive operator cylinder would likely require a larger bore diameter than the trolley operator cylinder to provide sufficient power to move the door. It should be evident that both types of operators can be provided with cylinders of various bore diameters as necessary.

Figure 4:
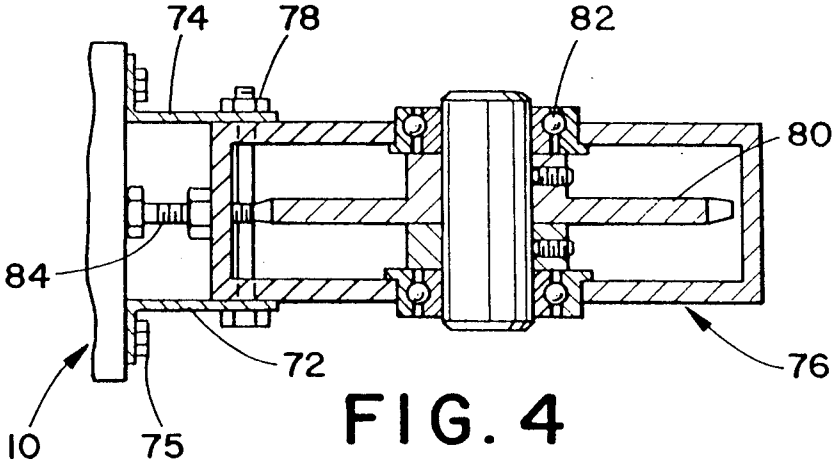
FIG. 4 is an enlarged reverse cross-sectional view of a rear idler housing of the operator of FIG. 2 along line 4—4.

With reference now to FIG. 4, a rear sprocket housing for the chain 60 includes a pair of angle brackets 72, 74 which are secured by suitable fasteners 75 to the rear of the cylinder body 10. A rectangular tube 76 is rotatably secured by a pivot means 78, such as a bolt, between the brackets 72, 74. A rear idler sprocket wheel 80 is rotatably mounted on a suitable bearing 82 secured to the rectangular tube 76. A chain adjustment bolt 84 is provided in spaced relationship to the pivot bolt 78 (i.e. above the axis of the rear idler sprocket wheel 80) in order to allow a pivotable adjustment of the tube 76 and the rear sprocket wheel 80 in relation to the cylinder 10, and hence an adjustment of the tightness of the chain 60.

Figure 3:
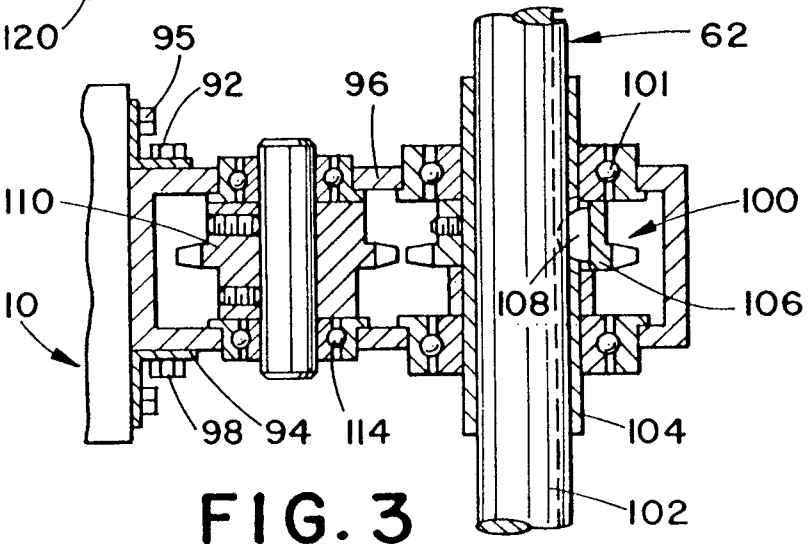
FIG. 3 is an enlarged cross-sectional view of a front housing for a in drive sprocket and idler sprockets of the operator of FIG. 2 along line 3—3.

With reference now to FIG. 3, a front sprocket housing includes a pair of angle brackets 92, 94 which are suitably secured by conventional fasteners 95 to the front of the cylinder body 10. A rectangular tube 96 is positioned between the two angle brackets and is suitably secured therebetween by conventional fasteners 98. Unlike the rear housing, the front housing does not pivot. A drive sprocket 100 is rotatably mounted on a suitable bearing 101 secured to the rectangular tube 96 such that a main drive rod or shaft 102 of the torsion bar 62 can extend through the sprocket. This is accomplished by providing a hollow metal bushing 104 on which is positioned a main drive sprocket wheel 106 with the bushing being fastened, such as by a key slot for a woodruff key 108, to the main drive shaft 102 which is suitably keyed.

It is noted in this connection that solid drive rods are generally keyed in order to allow the drums, for the cables on which the door is suspended, to be secured to the drive rods. In most instances, these keyways extend the entire length of the drive rod. Thus, the bushing 104 can be readily keyed with the woodruff key 108 to the drive shaft 102 without any modification needed to the shaft.

For small and light doors, sometimes a tube drive shaft is used instead of a solid drive shaft. In these doors, the drums are pinned to the tube shaft. Similarly, the bushing 104 could be secured by conventional pins to such a tube shaft (not illustrated) as is well known in the art.

Also provided on the rectangular tube 96 are a pair of spaced idler sprocket wheels 110, 112 around which the chain 60 is looped. These are substantially similar and each is mounted on a bearing 114 secured to the tube 96. It is noted that two small diameter idler sprocket wheels are provided in the front housing 90, in contrast to the large diameter idler sprocket wheel of the rear housing. This is done in order to enable the chain 60 to achieve more of a grip on the drive sprocket 100. The idler sprockets also perform the additional function of spacing the chain 60 away from the top and bottom surfaces of the cylinder. If desired, the front idler sprockets can have a pyramidal shape.

If desired, the chain 60 can also be spaced from the traveler 50 by the provision of guideways 116 secured thereto as is illustrated in FIG. 2. The chain 60 is spaced from the back side of the cylinder 10 by a rear idler sprocket wheel 118 as shown in FIGS. 1 and 2.

On advantage of using small sprocket wheels 106, 110, 112 in the front housing is that a limited movement of the chain 60 is able to efficiently rotate the shaft 102. This enables the door B to be moved with only a minimum movement of the actuator A.

In the design illustrated in FIGS. 1–4, the entire operator can be suitably positioned above and behind a door such that the bushing 104 can be fastened in the middle of the drive rod of even a wide door, such as an 18 ft. wide door.

With reference now to FIG. 5, secured on the traveler or carriage 50 is a cap 120 which has suitable elongated apertures 122 located thereon through which suitable conventional fasteners 124 can extend into the traveler. Secured on the cap is a keeper element 126 which has a top surface 128 that is provided with suitable spaced slots 130 into which one or more links 132 of the chain 60 can fit. It is noted that the elongated apertures 122 allow, upon a suitable loosening of the fasteners 124, a downward movement of the metal cap and therefore a disengagement of the chain keeper 126 from the links 132 of the chain 60. In this way, when the operator is first installed on the door, the traveler 50 can be moved to the desired location in relation to the door without having to disengage the chain from the drive sprocket secured to the torsion bar and then re-engage the chain once the operator and chain are correctly positioned in relation to the door. This saves a considerable amount of time and effort.

With reference again to FIG. 1, a front end of the cylinder 10 can be mounted on the torsion bar 62. A pair of hangers 146 can be fastened to a rear end of the cylinder and to the adjacent ceiling (not illustrated) to secure the cylinder in place.

Preferably, the door B includes a door member 150 which is made of a plurality of articulated longitudinally extending slats or planks. The door is adapted to slide up and down on a pair of spaced tracks 152, only one of which is illustrated in FIG. 1. In general, doors of this nature conventionally include a counterbalancing means such as an axial torsion spring 154 which is secured on the drive rod 102 above the door B. Cooperating with the drive rod 102 is a cable 156 which is secured on a first end to the door B (not visible in FIG. 1) and wound at its second end on a drum 158 axially driven by the drive rod.

In order to actuate the cylinder 10, a pressurized fluid circuit 160, preferably pneumatic, is provided. The circuit includes a first conduit 162 and a second conduit 164 each of which is in fluid communication with a respective end of the cylinder through the cylinder end caps 16,18. A source of pressurized fluid such as a compressor is in fluid communication with a respective one of the conduits 162, 164 through an inlet pipe 166 as directed by a control means 170. The control means can be in the form of a valve control in a housing which is interposed between the conduits 162, 164 and the inlet pipe 166 in order to control the movement of the rodless piston in the cylinder.

Figure 6:
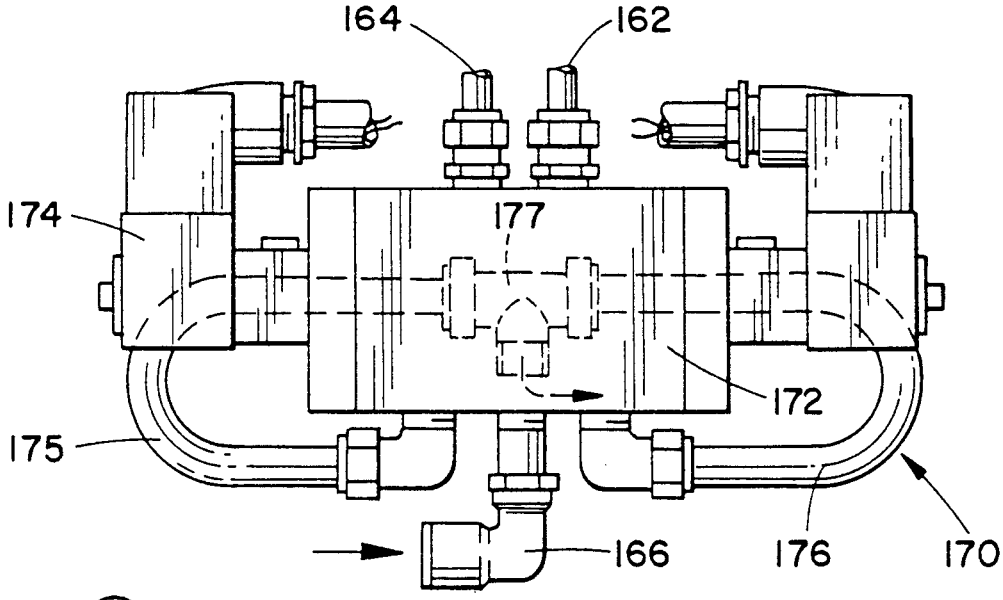
FIG. 6 is a front elevational view of a control means for the operator of FIG. 2.

With reference now to FIG. 6, the control means 170 can include a valve housing 172 which holds a conventional three position four way valve with open, stop, and close functions or a conventional two position four way valve with only open and close functions (not visible). Of course, it should be recognized that a wide variety of other types of valves could also be employed in the control means as the specific door application requires. Whatever type of valve is used, it can be controlled by conventional solenoids 174, as illustrated in FIG. 6, or by the other conventional means known in the art.

Figure 7:
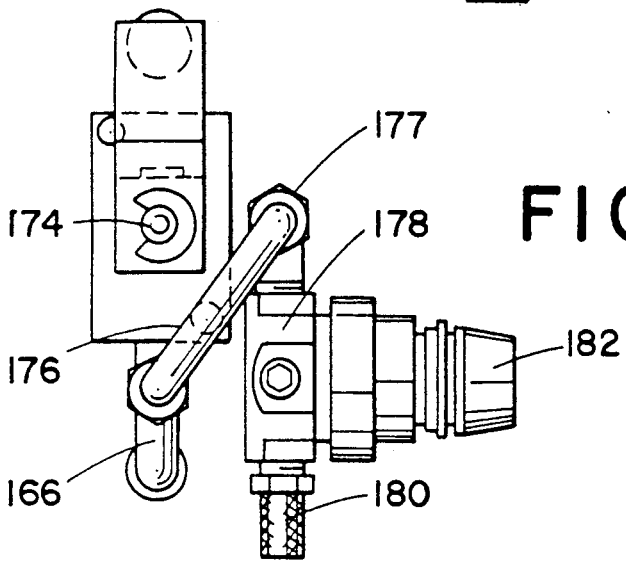
FIG. 7 is a side elevational view of the control means of FIG. 6.

The control means 170 can, as is illustrated in FIGS. 6 and 7, also include a pair of exhaust lines 175, 176 extending from the valve housing 172, which are joined by a T-fitting 177 and vent through an adjustment assembly 178, including a conventional pressure relief valve (not visible) held in a housing, and a muffler 180 in fluid communication with the relief valve, to the atmosphere. The exhaust assembly provides a pressure relief on both exhaust ports and will maintain a back pressure when the door is held in a mid-travel position. This will help to eliminate cable jumping when the operator is stopped in a mid-position of the door. The pressure relief valve will dump a certain amount of exhaust unless it receives pressure from the other side of the piston. Therefore, the back pressure on the piston will, to some extent, balance the forward pressure on the piston and reduce the tendency of the door, when stopped in mid-travel, to creep up or down as dictated by whichever side of the piston has the higher pressure on it.

An adjustment knob 182 is provided on the assembly 178 in order to regulate the rate at which the exhaust is vented to the atmosphere by the pressure relief valve and thus control the speed with which the piston will travel. In other words, the adjustment knob will enable one to adjust the rate with which the pressure relief valve will vent pressurized fluid from the exhaust conduits 175, 176 and thereby control the speed of piston travel.

The pressure relief valve, which may for the sake of quiet operation, be of the diaphragm type as is conventionally known, can be set to vent fluid which is at a pressure of greater than a predetermined amount. If desired, this vent pressure can be the fluid inlet pressure minus, for example, 20 psi. In this way, when the piston is moving exhaust fluid pressure can be vented but when piston movement stops, a substantial amount of pressure is maintained on the face of the piston opposite to the direction of motion.

With reference again now to FIG. 2, a bore 190 in the first end cap 16 enables pressurized fluid from the first conduit 162 to enter one end of the cylinder behind the piston first section 32 to urge the piston 30 toward the second end cap 18 of the cylinder. The second conduit 164 extends longitudinally down the cylinder 10 and is secured thereto by suitable hose clamps 192 (FIG. 1). The second conduit 164 communicates through a bore 194 in the second end cap 18 with the second end of the cylinder. A suitable conventional adjustable valve means such as a needle valve, of which a bore 196 is illustrated, can be provided in each end cap 16,18 to cushion the movement of the piston 30 adjacent the two ends of the cylinder.

If desired, suitable conventional micro switches 200 can be secured to the end caps 16,18 to activate additional electronic functions in conjunction with the opening and closing of the door. The micro switches 200 are connected to the control means 170 by suitable wiring 204. Alternatively, proximity switches can be utilized at the ends of the cylinder. Also, conventional magnetic reed switches could be positioned alongside the cylinder for position sensing of the piston between the ends of the cylinder. Such micro switches or the like can be useful, for example, to disengage an electrically controlled safety edge on the door when the door is in the closed position. A switch can also trip a timer when the door reaches the open position so that when a predetermined amount of time has elapsed the door will begin to close.

When a pressurized fluid such as compressed air or another suitable compressed gas is supplied by the pressurized fluid source 166 and the control means 170 is actuated to a door open position, the rodless piston 30 and its attached carriage 50 will be urged by pressurized fluid flowing through the first end cap 16 to move from a front end of the cylinder 10 towards a rear end thereof. At this time, the bore 194 and the second conduit 164 act as an exhaust means for exhausting fluid from a section of the cylinder between the second section 34 and the end cap 18 through the control means 170 and the adjustment assembly 178 to the environment. The carriage 50 thus moves thereby moving the chain 60 which rotates the torsion bar 62 and exerts a pull on the door B to open the door. The piston 30 slows down a few inches before contacting the cylinder body second end cap 18. The speed of movement of the piston 30 adjacent the end caps 16, 18 can be regulated by means of the adjustable valve means. Generally, the piston's speed of movement can be regulated through the directional valve in the control means 170 by use of the adjustment knob 182.

The piston 30, and hence the carriage 50, remains under pressure while the door B is in the open position until the control means 170 receives a signal electrically or manually to shift to another position.

When the valve 170 shifts to the closing direction, the bore or port 194 in the rear end cap 18 becomes a fluid supply while the bore or port 190 in the front end cap 16 becomes the exhaust. Therefore, the speed with which the door closes can be different from the speed with which the door opens. In some cases, for example in automated car washes, the door B requires a rapid opening cycle. This can be regulated by the adjustable knob 182. On the other hand, for safety reasons, the closing cycle should be at a normal speed, which is, at. a maximum, approximately 1 second per foot as is recommended by the Canadian Door Institute.

However, the door's speed could be set to slow, normal, or rapid speed to suit the particular door application involved. This setting can be done through an adjustment in the combination of the fluid flow and the exhaust restrictors. To stop the door at any intermediate position, one merely needs to provide a three position control valve which is actuated to a neutral or stop position in which it will block the flow of pressurized fluid to either end of the cylinder 10. Also, the motion of the door can instantly be reversed by having the directional valve shift from one direction to the other. This can be done either manually or electrically depending upon the type of controls used.

Since the cylinder 10 operates on a low pressure fluid (such as gas or air at 40 to 150 PSI), the cylinder does not move with enough force to cause damage to the door. More importantly, the door does not move with enough force to cause damage to objects or be hazardous to personnel.

The cylinder 10, carriage 50, and end caps 16,18 can all be made from any suitable material such as anodized aluminum. The piston 30 and the piston bracket 38 can be made from a suitable conventional material such as aluminum or steel. The sealing bands 25,26 can be made from a high density oil resistant plastic, or another suitable material and the various seals can be made from Buna N or another suitable rubber. One such suitable cylinder assembly is sold by the Norgren Martonair Co. under the designation LINTRA C/45000.

Figure 8:
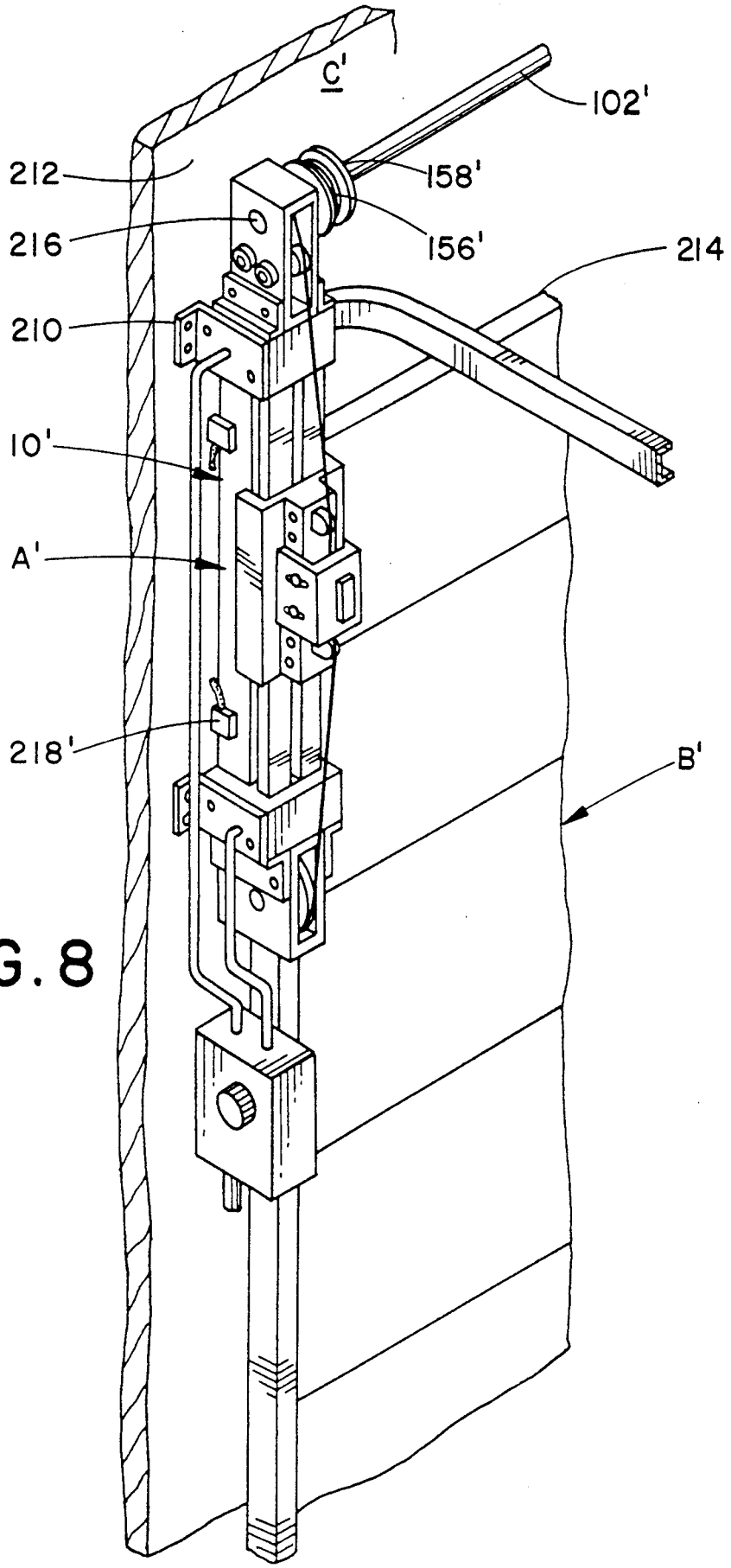
FIG. 8 is a perspective view of a second preferred embodiment of the door operator of the present invention mounted parallel to a sectional overhead door of a building.

FIG. 8 shows a second preferred embodiment of the invention as a side mounted or jack shaft-type operator for a garage door. For ease of illustration and appreciation of this modified construction, like components are identified by like numerals with primed (') suffix and new components are identified by new numerals.

In this FIGURE, the operator A' similarly includes a cylinder member 10' which is utilized on one side of a door B' that closes an opening in a building C'. The operator system A' is identical with that disclosed in FIGS. 1–7 above. In this embodiment, one or more braces 210 are used to secure the system A' to a wall 212 of the building C' adjacent a door opening 214. In this embodiment, a front housing of the system A' includes a bushing which slips over an end 216 of a drive rod 102' outside a drum 158' on which is wound a cable 156' attached to the door B'.

One advantage to using a non-electrically powered operator is that a magnet (not illustrated) can be inserted in the rodless cylinder piston so that the magnet can, by means of magnetic fields only, trip a magnetic switch 218, of the so-called Hall effect type, to actuate a function in relation to the door. Obviously, such magnet type remote actuators for magnetic switches were not possible with electric motor driven operators.

The operation of the system is the same as described above with regard to the first preferred embodiment.

An advantage of the second preferred embodiment over the conventional dual cylinder side mounted operator is that such operators are usually installed adjacent the floor of the building. Many times the door track gets hit at this location by vehicles also damaging the cylinders. The possibility for such damage is greatly reduced in the present invention by the positioning of the system A' near the top end of the door.

Additionally, the conventional dual cylinder air operator utilizes a single sprocket connected to the main door shaft and linked with a chain hanging down to the drive of the operator. This conventional system will apply a constant downward torque on the main door shaft and delivers an unnecessarily heavy load on the end bearing where the shaft is suspended. This wears the bearing and in many cases causes the bearing plate to cut through the shaft thereby necessitating a replacement of at least this portion of the torsion rod assembly utilized on the door. In contrast, in the present invention, a three sprocket arrangement is provided in the front housing and the cylinder is secured to the building wall adjacent the front housing. Since a small drive sprocket is utilized and the cylinder is secured to the wall adjacent the front sprocket housing, there is less of a tendency to deliver large loads to the drive rod 102' which would put a strong downward moment on the end 216 of the drive rod 102'.

The present invention thus provides a door operator system which minimizes frequent breakdowns, hazard to personnel, and damage to the door or objects which might be in the way of the door. Such a door operator is also believed to have a greatly improved life cycle in relation to the conventional electrically driven trolley door operators and to the conventional side mounted compressed air powered dual piston operators.

The invention has been described with reference to a pair of preferred embodiments. Obviously, modifications and alterations will occur to others upon the reading and understanding of this specification. It is intended to include all such modifications and alterations insofar as they come within the scope of the appended claims or the equivalents thereof.

What is claimed is:

1. An operator for opening and closing a door in which the weight of the door is substantially counterbalanced by a torsion spring assembly including a drive rod, the operator comprising:

a rodless fluid cylinder comprising a cylinder body, a rodless piston mounted for reciprocation in said cylinder body, and a carriage mounted for reciprocation externally along the length of said cylinder body, said carriage being secured to said piston;

a link means for operably connecting said cylinder carriage to the drive rod wherein said link means comprises a chain;

a connecting means for securing said chain to said cylinder carriage in a selectively releasable manner, said connecting means comprising a keeper element having teeth which engage said chain;

a drive sprocket wheel fastened to the drive rod which is located adjacent a first end of said cylinder body, wherein said chain is looped around said drive sprocket wheel and a rotation of said drive sprocket wheel is brought about by a movement of said cylinder carriage;

an idler sprocket wheel secured to a second end of said cylinder body wherein said chain is also looped around said idler sprocket wheel; and, a control means for controlling the operation of said fluid cylinder, and hence the position of the door.

2. The operator of claim 1 wherein said chain is looped around a longitudinal axis of said cylinder body.

3. An operator for opening and closing a door in which the weight of the door is substantially counterbalanced by a torsion spring assembly including a drive rod, the operator comprising:

a rodless fluid cylinder comprising a cylinder body, a rodless piston mounted for reciprocation in said cylinder body, and a carriage mounted for reciprocation externally along the length of said cylinder body, said carriage being secured to said piston;

a link means for operably connecting said cylinder carriage to the drive rod, said link means comprising a looped chain secured to said cylinder carriage;

an idler sprocket wheel secured to said cylinder body, said chain being looped around said idler sprocket wheel; and, a control means for controlling the operation of said fluid cylinder, and hence the position of the door.

4. The operator of claim 3 wherein said link means further comprises a drive sprocket wheel fastened to a bushing which is, in turn, secured to the drive rod, said chain being looped around said drive sprocket wheel.

5. The operator of claim 4 further comprising a front housing assembly secured to a front end of said cylinder body, said front housing assembly comprising:

a front bracket body; and, wherein said idler sprocket wheel comprises a front idler sprocket wheel rotatably mounted to said bracket.

6. The operator of claim 5 further comprising a roller chain support secured to said cylinder body on a surface opposed to a surface over which said cylinder carriage is secured.

7. The operator of claim 5 further comprising a connecting means for securing said chain to said carriage in a selectively releasable manner.

8. The operator of claim 4 further comprising a rear housing assembly secured to a rear end of said cylinder body, said rear housing assembly comprising:

a rear bracket body; and, wherein said idler sprocket wheel comprises a rear idler sprocket wheel rotatably connected to said bracket.

9. The operator of claim 8 wherein said bracket body comprises a pair of spaced angle brackets secured to said cylinder body, a central housing member positioned between said brackets and a fastener for securing said central housing member to said brackets such that said central housing member can pivot in relation to said brackets.

10. The operator of claim 9 further comprising a means for adjusting a tightness of said looped chain.

11. The assembly of claim 3 wherein said control means further comprises first and second exhaust lines extending from said valve to vent exhaust fluid from said fluid cylinder.

12. The assembly of claim 11 further comprising a back pressure relief valve in fluid communication with said first and second exhaust lines.

13. The assembly of claim 12 wherein said control means further comprises a speed control adjustment knob.

14. The system of claim 3 further comprising a pair of micro switches, one micro switch being located at each end of said cylinder, said micro switches being in electrical contact with said control means.

15. A gas powered operator system for a door that is raised and lowered with the aid of a torsion bar, comprising:

a cylinder comprising an elongated cylinder body having first and second ends, a rodless piston adapted for longitudinal reciprocation in said cylinder body, and a carriage adapted for reciprocation externally along the length of said cylinder body, said carriage being secured to said piston;

a looped chain secured to said cylinder carriage;

a drive sprocket wheel fastened to the torsion bar, wherein said chain is looped around said sprocket wheel;

a source of pressurized gas which is in fluid communication with said first and second ends of said cylinder;

an idler sprocket wheel secured to said cylinder body on a surface opposite a surface on which said cylinder carriage reciprocates, wherein said chain is looped around said idler sprocket wheel; and, a valve means interposed between said source of pressurized gas and said cylinder for selectively feeding pressurized gas to said cylinder first and second ends to reciprocate said rodless piston therein.

16. The system of claim 15 further comprising a control means for actuating said valve means said control means comprising a solenoid and a means for actuating said solenoid.

17. The system of claim 16 further comprising:

a pair of end caps for said cylinder body, each end cap sealing a respective end of said cylinder body; and, a pair of micro switches one micro switch being located at each end of said cylinder, said micro switches being in electrical contact with said control means.

18. The system of claim 16 further comprising:

first and second exhaust lines extending from said valve means to vent exhaust fluid from said fluid cylinder.

19. The system of claim 18 wherein said control means further comprises:

a back pressure relief valve in fluid communication with said first and second exhaust lines;

a speed control adjustment knob; and, a muffler in fluid communication with said back pressure relief valve, wherein said exhaust fluid is vented to the environment through said muffler.

20. An operator for opening and closing a door which is raised and lowered with the aid of a torsion bar, the operator comprising:

a rodless fluid cylinder comprising a cylinder body having a longitudinal axis and having a first end and a second end as well as a first side and a second side, a rodless piston mounted for reciprocation in said cylinder body, and a carriage mounted for reciprocation externally along the length of said cylinder body along said first side thereof, said carriage being secured to said piston;

a looped chain secured to said cylinder carriage;

a first idler sprocket wheel operably secured to said cylinder body first end;

a second idler sprocket wheel operably secured to said cylinder body second end; and, a drive sprocket wheel secured to the torsion bar, wherein said looped chain is looped around said first and second idler sprocket wheels and said drive sprocket wheel.

21. The operator of claim 20 further comprising a roller chain support secured to said cylinder body second side, wherein said looped chain is looped around said cylinder body along said longitudinal axis thereof.

22. The operator of claim 20 further comprising a connecting means for securing said looped chain to said carriage in a selectively releasable manner.

* * * * *